United States Patent [19]

Samson et al.

[11] Patent Number: 4,644,838

[45] Date of Patent: Feb. 24, 1987

[54] APPARATUS FOR HELICAL CUTTING OF POTATOES

[75] Inventors: Dennis J. Samson, Connell; George R. Alcorn, Pasco, both of Wash.

[73] Assignee: Rogers Walla-Walla, Inc., Pasco, Wash.

[21] Appl. No.: 651,760

[22] Filed: Sep. 18, 1984

Related U.S. Application Data

[63] Continuation-in-part of Ser. No. 534,182, Sep. 20, 1983, abandoned.

[51] Int. Cl.[4] ..... B26D 3/11

[52] U.S. Cl. ..... 83/865; 83/162; 83/168; 83/356.3; 83/411 A; 83/417; 83/431; 83/437; 83/444; 83/446; 83/926 R

[58] Field of Search ..... 83/356.3, 356.1, 355, 83/402, 431, 444, 446, 411 A, 666, 675, 592, 733, 652, 425.1, 162, 417, 168, 437; 241/92, 228; 99/543, 545; 408/86, 209, 214

[56] References Cited

U.S. PATENT DOCUMENTS

| | | | |
|---|---|---|---|
| 97,047 | 11/1869 | Chrysler | 83/592 X |
| 101,520 | 4/1870 | Schaub | 83/592 X |
| 497,675 | 5/1893 | Miller . | |
| 1,212,915 | 1/1917 | Doughtry | 83/652 X |
| 1,534,078 | 4/1925 | Ruffner . | |
| 1,970,997 | 8/1934 | Dorman | 241/92 |
| 2,017,559 | 10/1935 | Wolfinger | 83/865 |
| 2,464,993 | 3/1949 | Ross | 83/425.1 X |
| 2,610,664 | 9/1952 | Thompson . | |
| 2,826,229 | 3/1958 | Necula . | |
| 3,057,386 | 10/1962 | Massaro | 83/446 X |
| 3,109,468 | 11/1963 | Lamb et al. | 83/402 X |
| 3,217,768 | 11/1965 | Lamb | 83/858 X |
| 3,318,351 | 5/1967 | Werder | 83/446 X |
| 3,952,621 | 4/1976 | Chambos | 83/733 |
| 4,050,339 | 9/1977 | Soleri | 83/411 A X |
| 4,228,963 | 10/1980 | Yamauchi et al. | 83/446 X |
| 4,368,651 | 1/1983 | Pellaton | 83/356.3 |
| 4,387,111 | 6/1983 | Mullender | 83/733 X |
| 4,393,737 | 7/1983 | Shibata | 83/356.3 |

FOREIGN PATENT DOCUMENTS

| | | |
|---|---|---|
| 0059075 | 9/1982 | European Pat. Off. . |
| 333015 | 8/1930 | United Kingdom . |
| 599039 | 4/1948 | United Kingdom . |

OTHER PUBLICATIONS

Kurly Ku Potato Cutter Assembly & Parts List, Bloomfield Indust. Inc., Part No. 27-24, Dwg. No. 2948-A.

*Primary Examiner*—Frank T. Yost

*Attorney, Agent, or Firm*—John C. Cooper, III; Fred Wiviott

[57] ABSTRACT

A method and apparatus for cutting articles such as potatoes into helical strips wherein the potato is held against rotation and aligned by a plurality of fingers and moved longitudinally against a rapidly rotating cutting head. The cutting head may include a hollow central cutting tube mounted at its axis of rotation. A feed mechanism is provided to feed potatoes to the holder for cutting and automatic sensing and sequencing control system controls the loading and feeding of potatoes. A plurality of holding and cutting mechanisms can be simultaneously fed and operated by the control system.

18 Claims, 24 Drawing Figures

FIG. 6
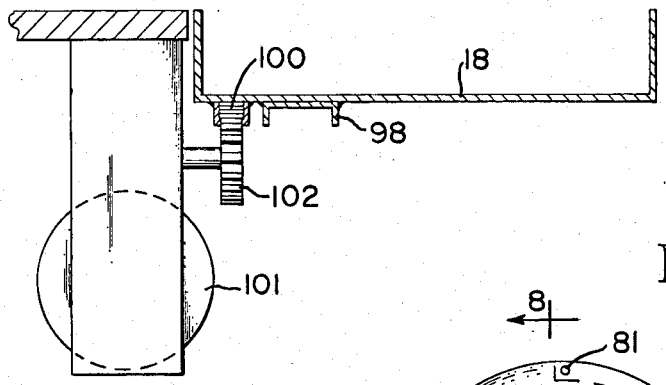
FIG. 7
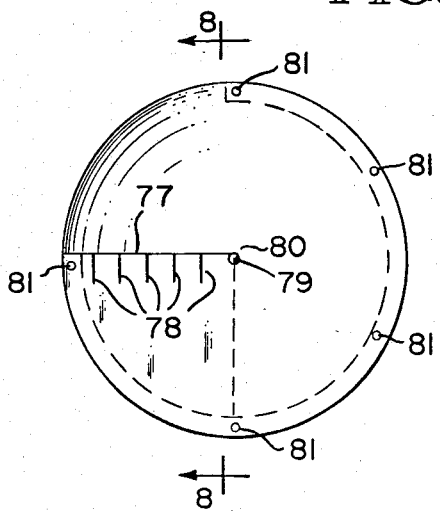
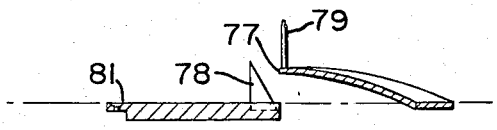
FIG. 8
FIG. 10
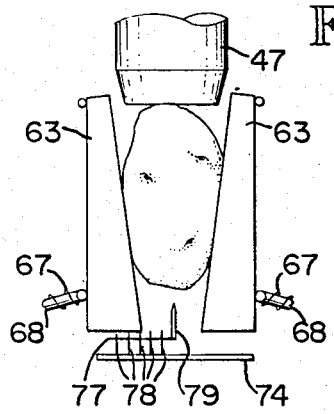
FIG. 11
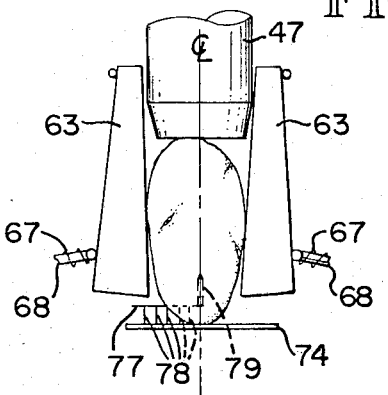
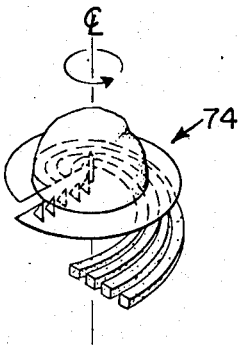
FIG. 12
FIG. 13
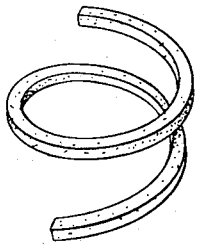

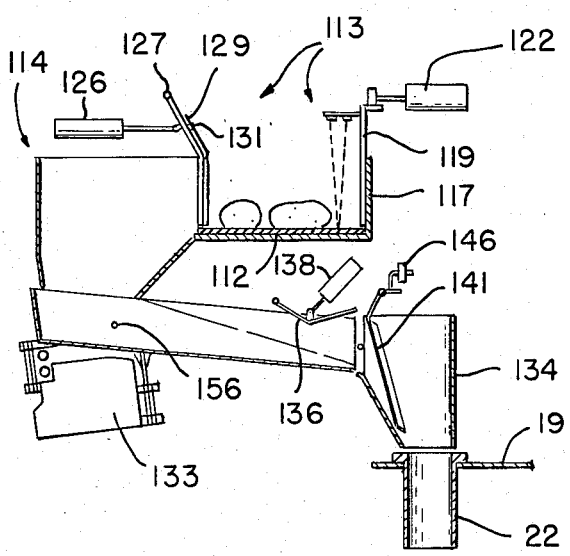
FIG. 20
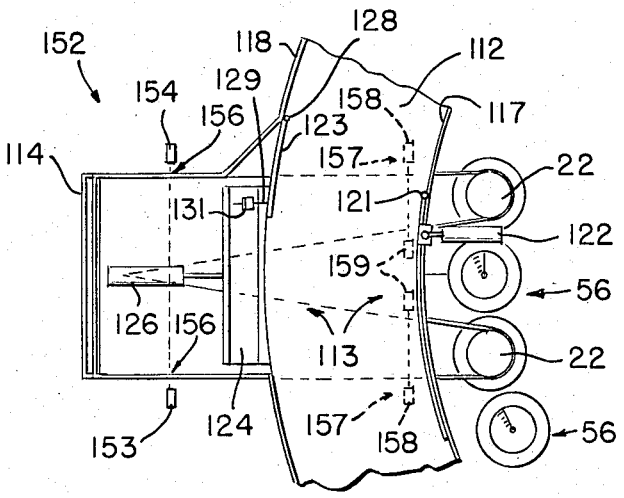
FIG. 21
FIG. 22
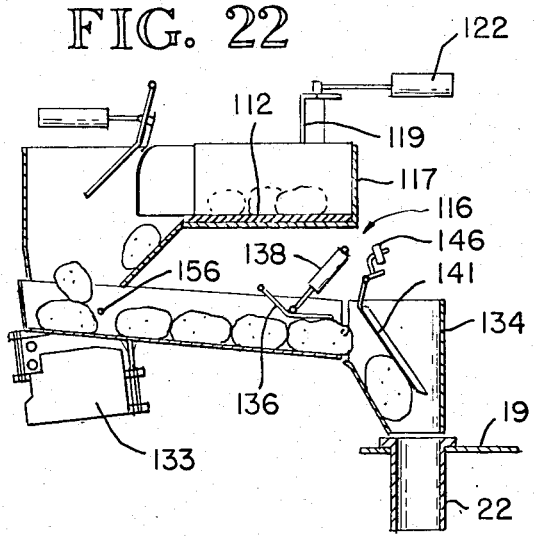
FIG. 23
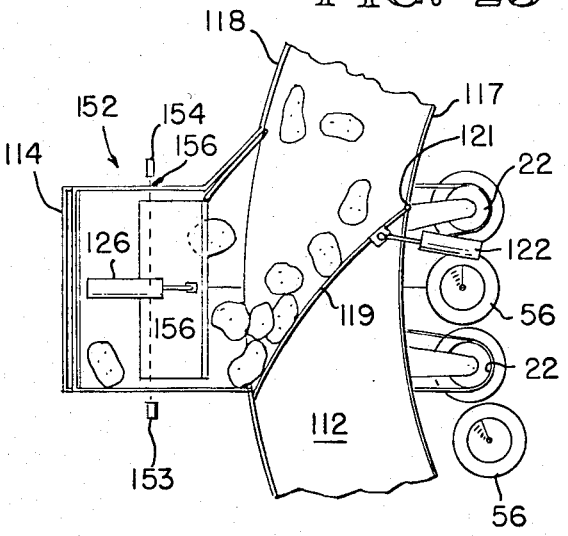

APPARATUS FOR HELICAL CUTTING OF POTATOES

This application is a continuation-in-part of application Ser. No. 534,182, filed Sept. 20, 1983 now abandoned.

FIELD OF THE INVENTION

The present invention relates to the cutting of vegetables preparatory to processing and in particular to the cutting of potatoes into a plurality of helical strips.

BACKGROUND OF THE INVENTION

Raw potatoes and other vegetables have in the past been cut into pieces for cooking or freezing in a variety of ways using various apparatus. One method of cutting potatoes for making a french fried potato product strip involves a fixed blade cutter against which a potato is rotated to cut it into a plurality of helical strips. This mechanism includes a cutting plate on which is mounted a pivot pin for engaging one end of a potato. The other end of the potato is engaged by a toothed drive disk which is mounted opposite the plate on a crank driven shaft. A set of slitting knives protrude from the surface of the cutting plate and a cutting knife is mounted to the cutting plate adjacent the pivot pin. The blade of this knife extends radially from the pivot pin in a plane parallel to the surface of the cutting plate. These knives cut the potato into a plurality of helical strips as it is rotated against the cutting plate.

Although this device produces helically-cut potato strips, it suffers from several problems. First, since the potato is rotated against the cutting plate, a center core of the potato is produced and progressively crushed against the plate resulting in wastage and degradation of the product. The toothed drive disk further results in waste since the potato cannot be cut into helical strips from end to end without interference between the teeth of the drive disk and the cutting knives. The speed of operation of this device is further limited by the time required to load a potato into axial alignment with the pivot pin and drive disk and by the limitations on rotational speed of the potato.

BRIEF DESCRIPTION OF THE INVENTION

The present invention overcomes the difficulties of the prior art cutting device and provides a method for rapidly cutting a potato into a plurality of helical strips without wastage of significant portions thereof. It has been found that superior and rapid cutting of the potato can be achieved by holding the potato against rotation and moving it into engagement with a rotating cutter head. A high rotational speed of the cutter head relative to the potato can thus be achieved, resulting in the rapid reduction of the potato into a plurality of helical strips. In order to achieve this result, a cutter head is used which includes a plurality of slitting knives which extend outward in generally parallel alignment with the axis of rotation of the cutter head. These knives are positioned to form concentric longitudinal cuts in the potato. Helical strips are then produced by a transverse blade, the cutting edge of which protrudes from the face of the cutter head, as the cutter head is rotated against the potato. The cutting head may include a center pin for engaging the potato or, alternately, may include an upstanding cutting tube mounted at the center of rotation of the cutting head. The end of this tube is sharpened and cuts a cylinder of material from the center of the potato. The remainder of the potato is reduced to helical strips which have an internal radius at least as great as the radius of the cutting tube. All of the helical strips are thus able to expand lengthwise more freely and breakage thereof is less likely to occur during the cutting process.

It has also been discovered that the potato can be held against rotation during the cutting process without the use of devices which penetrate and cut the potato and which may interfere with the cutting of the entire potato into helical strips. This is accomplished by use of a tubular potato holder which includes a plurality fingers mounted to bear inwardly against the potato. The inner surfaces of these fingers are blunt to prevent cutting of the potato. In addition to their function in holding the potato, these fingers also center the potato as it is inserted into the holder.

The potato is forced into engagement with the cutting head by means of a plunger. The sides of the plunger are deeply grooved at locations corresponding to each of the fingers so that the plunger may be extended through the cup without interfering with the holding and centering action of the fingers. In order to maximize utilization of the potato, the plunger is designed to be extended into the cup down to the rotating cutting head. Concentric grooves are provided in the end of the plunger to accommodate the upstanding slitting knives which extend upward above the level of the transverse blade.

During operation of the cutting mechanism, the cutter head is kept free from excessive debris by flowing water upwardly along its sides and over its surface. This water washes through the aperture in the cutting head beneath the transverse blade.

The cutting head is mounted on a rotatably driven tube. This tube serves not only to conduct the rinsing water away from the cutting head but also to conduct the helically cut potato strips to a conveyor or bin. At high rotational speeds of the cutting head, however, the helically-cut strips of potato may be held against the walls of the drive cylinder by centrifugal force. In order to avoid this problem, a sleeve is mounted in the tube to provide a non-rotating chute through which the water and potato strips are conducted away from the cutting head. In addition, the base of the drive tube is surrounded by a splash shield which contains any water that may leak outward past the top of the sleeve.

The feeding and cutting of the potatoes may be automated as a result of the aforementioned configuration of the cutting mechanism. Preferably, one or more cutting mechanisms are mounted on a table. An indexed table is provided with a plurality of cups for receiving potatoes. The bottom of these cups are open and positioned above a support plate. An indexing mechanism is provided to rotate the indexed table in predeterminal increments. When one of the cups is indexed into position above the potato holder and cutter head, it drops through a hole in the support plate and into the holder. A plunger mechanism is then energized to force the potato downward against the cutting head. When the cutting cycle is completed, the plunger withdraws to a position above the cup, the indexing mechanism is actuated, and the next cup is moved into position to deliver a potato for cutting. Workers may be positioned about the periphery of the machine to manually insert potatoes into the cups in the indexed table. Potatoes may be supplied to these workers by means of a conveyor ring around the machine which continuously circulates the potatoes until they are picked up for loading. This conveyor may be supplied with potatoes by a vibrating conveyor or other known conveyor mechanism.

Alternately, potatoes may be supplied to the cups by means of an automatic feed mechanism. This feed mechanism may comprise an annular conveyor which circulates about the machine at a level above the cups. An infeed conveyor feeds potatoes to the annular conveyor and is controlled in response to a sensor to maintain an adequate supply of potatoes on the annular conveyor. Diverter gates are positioned at various locations about the annular conveyor to divert potatoes from the annular conveyor to feed hoppers. Potatoes are fed from the hopper to a vibrating chute which aligns the potatoes for cutting and transports them past an indexing mechanism which insures that no more than a single potato is loaded into any cup. A curved gravity biased plate engages potatoes released by the indexing mechanism to guide them to the cup and prevent them from tumbling as they are guided into the cup. Potatoes may be swept onto the annular conveyor from a belt conveyor and through a door by a diverter gate which is movable between a retracted position, an extended position and an intermediate position in response to signals from two sensor pairs which monitor the presence of potatoes on the annular conveyor.

The apparatus is preferably controlled by an automatic sensing and control mechanism which automatically senses the position of various of the elements of the apparatus and of the sequences the operation thereof in response to this sensing.

BRIEF DESCRIPTION OF THE DRAWINGS

FIG. 6 is a cross-sectional view of the conveyor of FIG. 1 with parts broken away.

FIG. 7 is a top plan view of a cutter according to the present invention.

FIG. 8 is a cross-sectional view of a cutter assembly according to the present invention taken along line 8—8 of FIG. 7.

FIG. 10 is a schematic representation depicting the loading of a potato into the holding means.

FIG. 11 is a schematic representation of a potato in position for cutting.

FIG. 12 is a schematic representation of a potato in position for cutting.

FIG. 13 is a perspective view of a helical strip of potato.

FIG. 20 is a cross-sectional schematic of the feed system with parts broken away.

FIG. 21 is a top schematic view of the feed system with parts broken away.

FIG. 22 is a cross-sectional schematic of the feed system with parts broken away and showing the indexing mechanism activated to stop the flow of potatoes along the chute.

FIG. 23 is a top schematic view of the feed mechanism system with parts broken away and showing the hopper doors open and the diverter gate extended.

DETAILED DESCRIPTION OF THE PREFERRED EMBODIMENT

Figure 1:
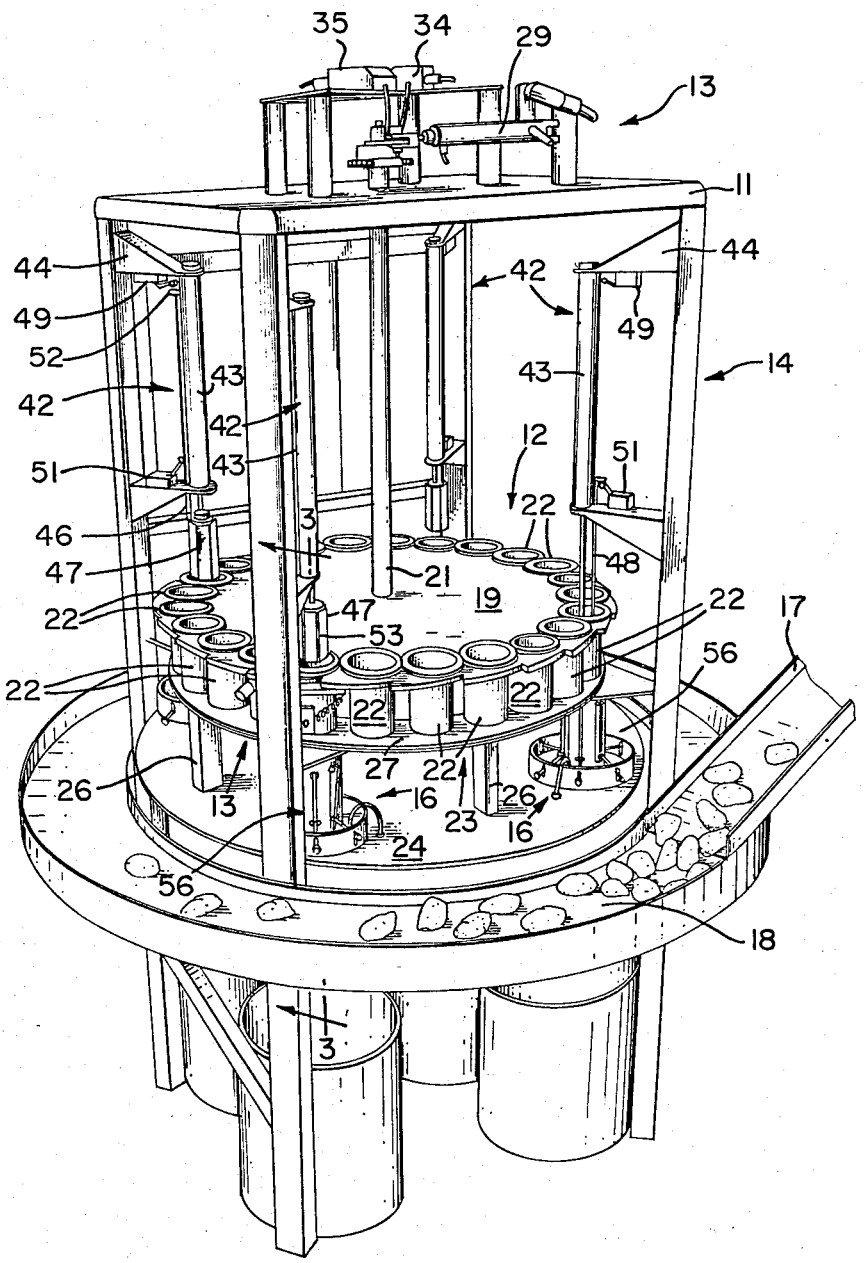
FIG. 1 is a perspective view of an apparatus according to the present invention.
Figure 2:
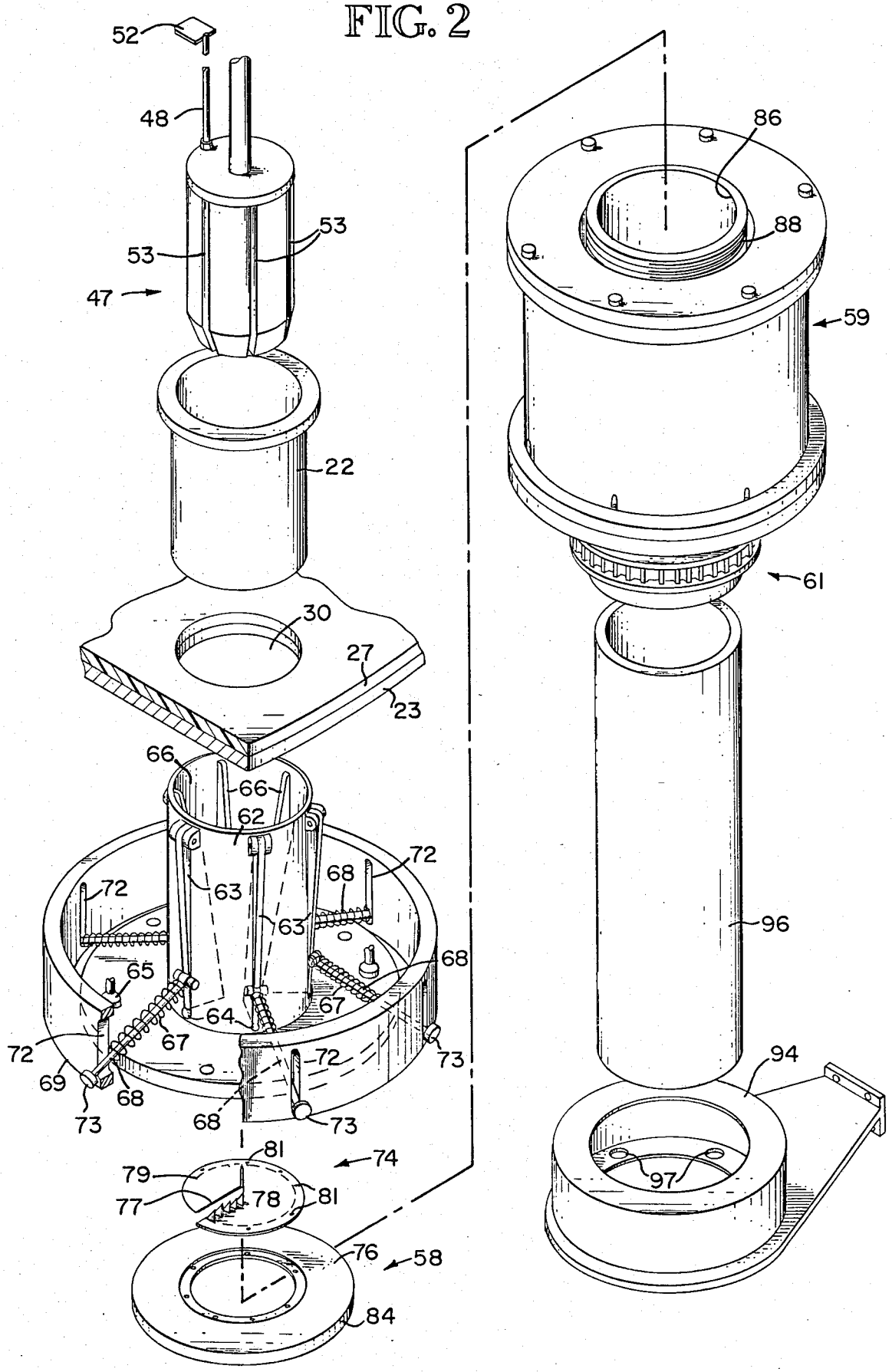
FIG. 2 is an exploded perspective view of the feeding, holding and cutting mechanism of FIG. 1 with parts broken away.
Figure 3:
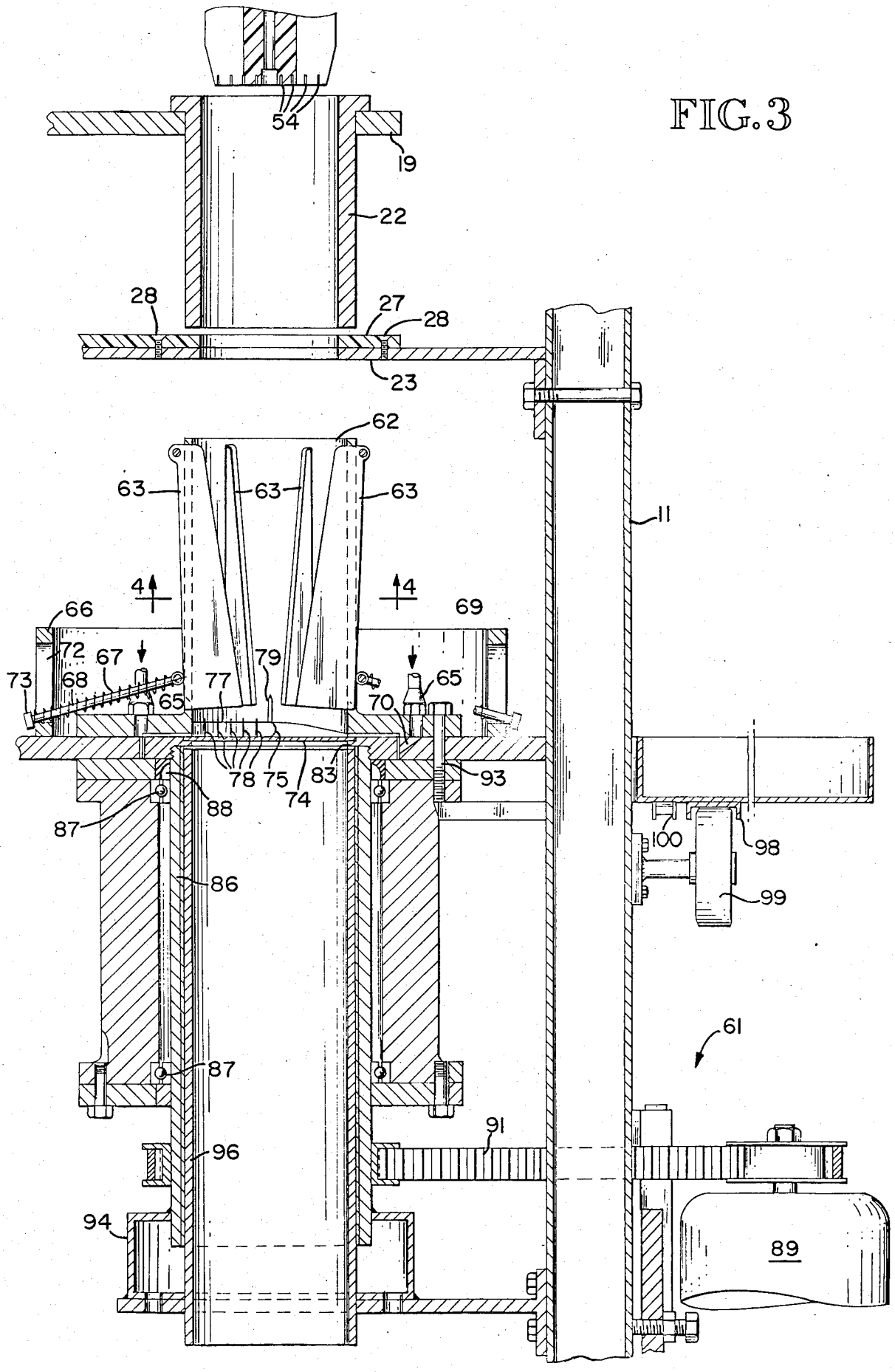
FIG. 3 is a cross-sectional view of the feeding, holding and cutting mechanisms of FIG. 1 taken along the line 3—3 of FIG. 1 with parts broken away.

The present invention provides a new method and apparatus for rapidly and automatically cutting vegetables such as potatoes into elongated helical strips. As best shown in FIGS. 1, 2 and 3 this mechanism includes a frame 11 to which is mounted a rotatable feed mechanism 12, which is driven by an indexing system 13. A plunger system 14 and cutting system 16 are positioned about the periphery of the device. A vibrating conveyor mechanism 17 transports potatoes to an annular supply tray 18 which is rotatably mounted to the frame 11.

As best illustrated in FIGS. 1–3 and 5 the feed mechanism 12 includes a feed table 19 mounted on a rotatable vertical shaft 21. The table 19 is of generally circular configuration and includes a plurality of open-bottomed feed cups 22 mounted in apertures about its periphery. The open lower ends of the cups 22 are positioned immediately above an annular support plate 23 which is mounted to the frame 11 and supported above the surface of the table 24 by a plurality of support legs 26.

As best illustrated in FIGS. 2 and 3, a strip of low friction plastic material 27 is positioned beneath the cups 22 and mounted to the support plate 23 by means of a plurality of countersunk screws 28. Apertures are provided in the support plate 23 and plastic material 27 at positions such that potatoes can be loaded into the cutting system 16.

Figure 5:
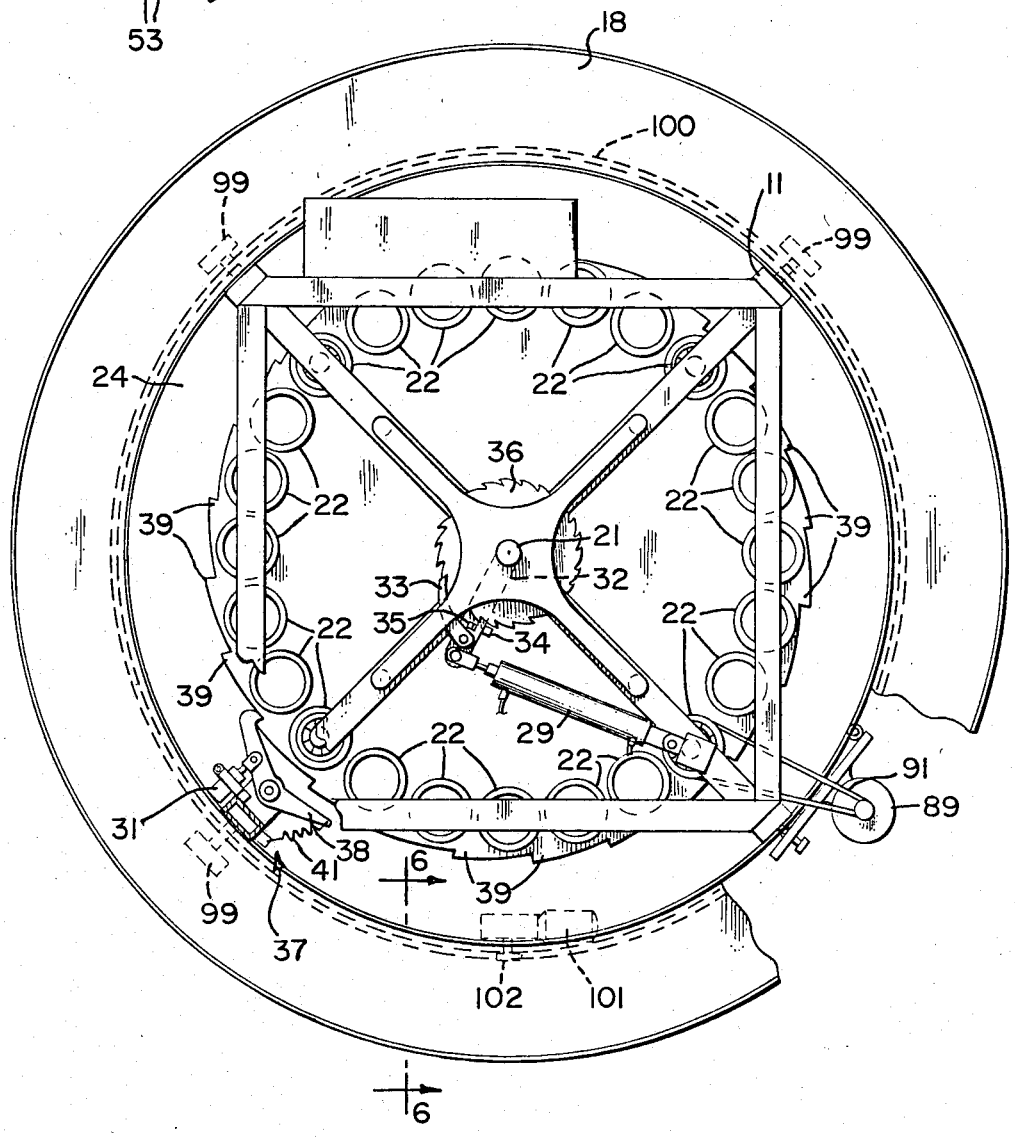
FIG. 5 is a top plan view of the apparatus of FIG. 1 with parts broken away.

Referring next to FIGS. 1 and 5, the indexing mechanism 13 is operated by means of a pneumatic drive cylinder 29 and pneumatic locking cylinder 31. One end of the drive cylinder 29 is mounted to the frame 11 and the other is attached to the free end of a ratchet arm 32. The other end of the ratchet arm 32 is pivotably mounted to the shaft 21. A pawl 33 is pivotably mounted to the arm 32 adjacent the attachment point of the drive cylinder 29 and is spring biased into engagement with a ratchet wheel 36 which is, in turn, mounted on the shaft 21. A pair of limit switches 34, 35 are positioned, respectively, to close when the cylinder 29 is in its fully retracted and extended positions. Extension of the drive cylinder 29 thus results in rotation of the arm 32, pawl 33, ratchet wheel 36 and shaft 21. Since the feed table 24 is also attached to the shaft 21, operation of the drive cylinder results in rotation of the table 24. The length of the arm 32 and stroke of the cylinder 29 are chosen such that operation of the cylinder further results in sufficient movement of the table to position the next set of cups 22 above the apertures 30 in the support plate 23.

The lock cylinder 31 actuates a locking mechanism 37 which prevents rotation of the cups 22 past the desired location. As best shown in FIGS. 1 and 5, this lock mechanism 37 comprises a latch 38 which is mounted to the frame 11 and biased into engagement with the teeth 39 formed in the edge of the feed table 19 by a spring 41. The teeth 39 and latch 38 are configured to restrict rotation of the table 19 such that each feed cup 22 may be locked into position above the cutting system 16 in turn. Actuation of the lock cylinder 31 retracts the latch 38 and frees the feed table 19 to rotate. The index table may also, of course, be driven by an electric motor and the position of the table sensed by cam actuated switches as is known in the art.

Referring next to FIGS. 1–3, the plunger mechanism 14 comprises four identical plunger units 42. Each plunger unit 42 includes a double acting pneumatic cylinder 43 mounted to the frame 11 by upper and lower brackets 44, 46. The plunger head 47 is mounted on the shaft of the pneumatic cylinder 43. A rod 48 is mounted to the plunger head 47 and is slideably supported by the lower bracket 46 for vertical movement with the plunger head 47. Upper and lower limit switches 49, 51 are mounted on the upper and lower brackets 44, 46 in position for actuation by a tab 52 mounted on the free end of the rod 48, respectively, when the pneumatic cylinder is fully retracted or extended.

Figure 4:
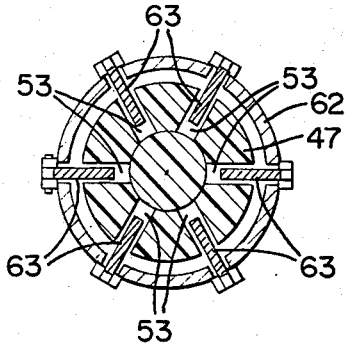
FIG. 4 is a cross-sectional view of the plunger and holding mechanisms of FIG. 3 taken along the line 4—4 of FIG. 3 with parts broken away.

Referring more particularly to FIGS. 2–4, the plunger head 47 is formed with deep grooves 53 extending longitudinally along it sides. In addition, concentric circular grooves 54 are formed into the lower surface of the plunger head 47. These grooves 53, 54 cooperate with elements of the cutting mechanism 16 as described below to provide complete and accurate cutting of potatoes or other vegetables.

The cutting mechanism 16 comprises four identical cutting units 56. As best shown in FIGS. 1–3, these cutting units 56 include a holder 57 for receiving and aligning potatoes for cutting. The holder 57 also secures the potatoes against rotation during the cutting process. The cutting units 56 include a rotatable cutter mechanism 58, a support 59 for rotatably mounting the cutter mechanism to the table 24, and a drive unit 61 for rotatably driving the cutter mechanism 58.

Referring more particularly to FIGS. 2 and 3, the holder 57 includes a tubular body 62 mounted on a base plate 71 for receiving potatoes. A plurality of fingers 63 are hinged to the body 62 adjacent its upper lip and extend into the body 62 through corresponding slots 64. The inner surface 66 of each finger 63 is blunt to prevent cutting of the potatoes held in the body 62.

A pin 68 is pivotably connected to each of the fingers 63 and mounts a spring for independently biasing the corresponding finger 63 into the interior of the tubular body 62. The outer end of the springs 67 bear against a ring 69 which is not mounted on the base plate 71 but rather is free to float as the fingers 63 move upon positioning of a potato in the holder 57. This allows the holder 57 to accommodate and align even highly irregular potatoes concentrically with the tubular body 62. The pins 67 extend through slots 72 in the ring 69 and include heads which bear against the outer surface of the ring 69 to limit inward travel of the fingers 63.

Figure 14:
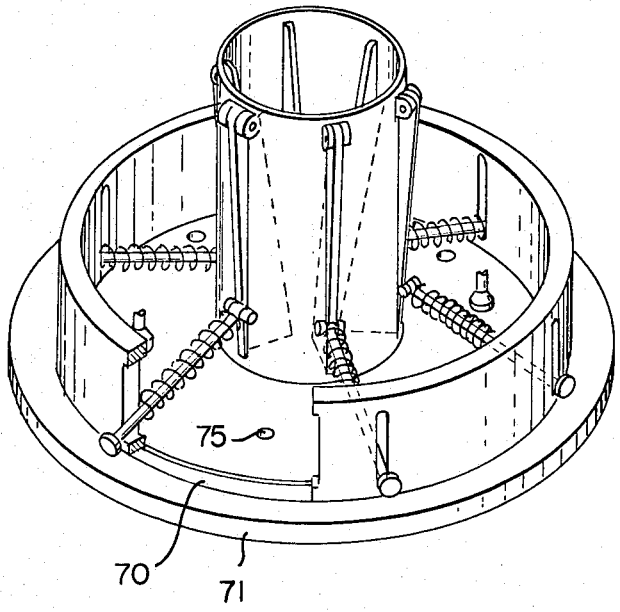
FIG. 14 is a perspective view of an alternate potato holding means.

As shown in FIGS. 2 and 3, a pair of nozzles 65 are mounted on the base plate 71 for supplying rinse water to the cutting head 58. Some of the rinse water supplied to the cutting head 58 may be impelled upward into the tubular body 62 of the holder 57 and exit through the slots 64. The holder may alternatively be constructed to remedy this problem. As shown in FIG. 14, the water can be contained and prevented from flowing out onto the table 24 by mounting the ring 69 in a groove 70 in the base plate 71. Any water which accumulates within the confines of the ring 69 is drained away through one of the drain holes 75 in the base plate 71.

As shown in FIGS. 2, 3, 7 and 8, the cutter mechanism 58 includes a blade assembly 74 and a flanged blade mount 76. The blade assembly 74 is generally disk shaped and includes a raised transverse blade 77 the edge of which extends radially from the center of the assembly 74. The transverse blade 77 is supported above the surface of the assembly 74 by a shoulder 75 on the opposite side of the center of the assembly 74. A plurality of upstanding slitting knives 78 extend upwardly from the surface of the blade assembly 74 and are removably attached thereto for example by soldering. The slitting knives extend upward from the surface of the assembly 74 to a position approximately 1/16 of an inch above the upper surface of the transverse blade 77. A center pin 79 is attached to the transverse blade 77 at the center of the blade assemby 74. The pin 79 does not extend below the lower surface of the transverse blade 77 nor do any obstructions depend from the lower surface of the blade assembly. This minimizes damage and breakage of the spiral strips of potatoes as they are cut and eliminates crushing of any portion of the potato against the surface of the blade assembly 74. The piercing action of pin 79 adjacent the edge of blade 77 produces an inner helical strip in lieu of a core.

The blade assembly 74 includes a plurality of mounting holes 81 about its periphery which correspond to holes 82 in the recessed interior flange 83 of the blade mount 76. Flush mounting screws (not shown) are used to secure the blade assembly 74 to the blade mount 76 and do not project from either the upper or lower surface of the cutter assembly 58. As best shown in FIG. 3, the outer flange 84 of the blade mount 76 is threaded for mounting on the cutter drive assembly 61. As best shown in FIGS. 2 and 3, rinse water is conducted form the nozzles 65 to the cutting head 58 through channels 70 in the table 24. Water from the nozzles 65 flows upward along the side of the cutter head 58 and onto the blade assembly 74, washing scraps of potato out through the aperture below the transverse blade 77.

Although this blade assembly 74 produces the complete helical cutting of the potato, the innermost helical strip cut by the blade assembly 74 has only the internal radius produced by piercing of the potato by the pin 79. As such, this helical strip is extremely tightly coiled and to some extent is subject to breakage.

Figure 15:
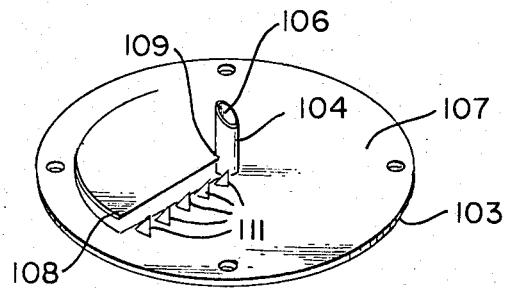
FIG. 15 is a view of a cutting blade assembly including a center cutting tube.

As illustrated in FIG. 15, this problem can be overcome by the use of a blade assembly 103 which includes a cutting tube 104 at its center in place of the pin 79 of the blade assembly 74 illustrated in FIGS. 7 and 8. The upper end 106 of this tube is cut off at a 45 degree angle and is sharpened about its periphery so that it not only penetrates the potato but actually cuts a cylindrical core from the center of the potato. The cutting tube 104 is attached to the mounting plate 107 about most of its periphery but is not mounted to the transverse blade. The demountable transverse blade 108 is attached to the mounting plate 107. The corner 109 of this blade which abutts the cutting tube 104 is notched to conform to the periphery of the tube 104. The tube 104 can extend below the level of the horizontal knife without causing breakage of the innermost helical strip cut by the blade assembly 103, since this strip has a radius approximately equal to the radius of the cutting tube 104.

Breakage of the helical strips can also be reduced by selection of the proper shape for the slitting knives 111. These knives 111 extend vertically from the blade assembly 74 and travel in a circular path as the blade assembly is rotated. It has been found that bending the knives 111 such that the radius of curvature of each knife 14 is approximately equal to the radius of the circular path traveled by such knife 111 advantageously reducing the tendency of the helical strips of potato to break during cutting and handling.

The cutter drive assembly 61 includes a drive tube 86 which is rotatably supported in the cutter support housing 59 by upper and lower ball bearings 87. The upper end of the drive tube is threaded to receive the cutter assembly 58 and a seal 88 is positioned between the support housing 59 and drive tube 86 to seal out water from the nozzles 65. A pulley is mounted adjacent the lower end of the drive tube 86 and is driven by an electric motor 89 by means of a toothed belt 91. The cutter housing 59 and holder 57 are both mounted to the table 24 and are maintained in alignment with an aperture 92 therein by bolts 93 which extend through the base plate 71 of the holder 57 to engage the housing 59.

A spray shield 94 is mounted to the frame 11 and encircles the lower end of the drive tube 86. A tubular chute 96 is mounted to the spray shield and extends upwardly into the drive tube 86 to a position just beneath the cutter assembly 58. This chute 96 conducts the strips of helically-cut potato strips and rinse water away from the cutter assembly 58 and prevents contact between the helically-cut potato strips and the rotating drive tube which otherwise could result in the strips being held against the walls of the tube by centrifugal force. Any water which leaks between the drive tube 86 and cute 96 drains to the bottom of the drive tube 86 and is caught by the spray shield 94 and drains out through the holes 97 in the bottom of the shield 94.

Referring next to FIGS. 1, 3, 4 and 6, the annular conveyor 18 surrounds the frame 11. A flanged track 98 is attached to the bottom of the conveyor 18 to receive the support wheels 99 which are rotatably mounted to the frame 11. A drive chain 100 is also attached to the bottom of the conveyor 18 along a circular path. A conveyor drive motor 101 drives a sprocket 102 which is positioned to engage the chain 100 and rotate the conveyor 18.

Although the present apparatus as illustrated in FIG. 1 is shown as including only four plunger units 42 and cutting units 56, additional plunging units and cutting units 42, 56 may be spaced about the apparatus. Of course, it is necessary that these units be spaced apart by at least one feed cup 22 so that potatoes can be fed to all cutting units 56.

Figure 17:
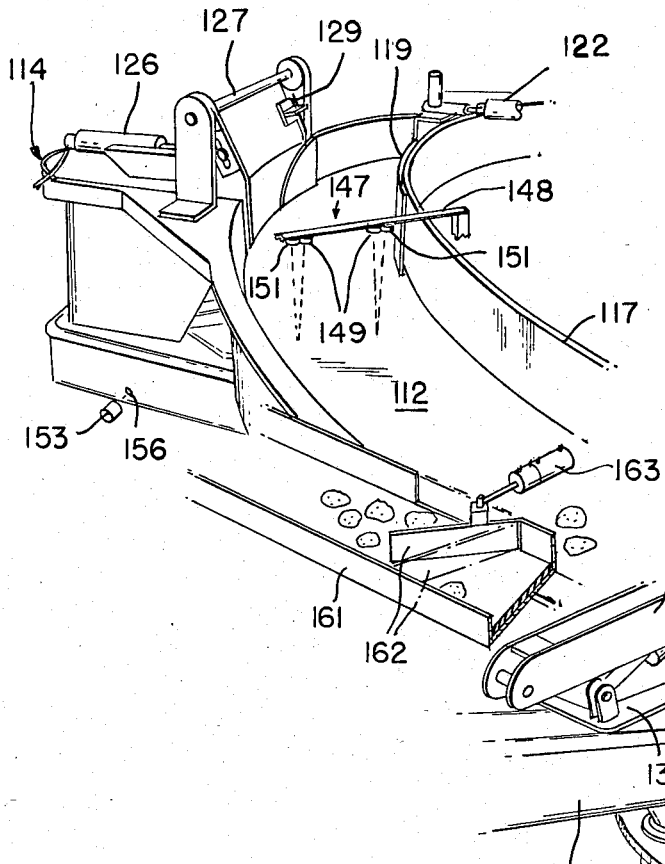
FIG. 17 is a perspective view of an automatic feed system with parts broken away.
Figure 18:
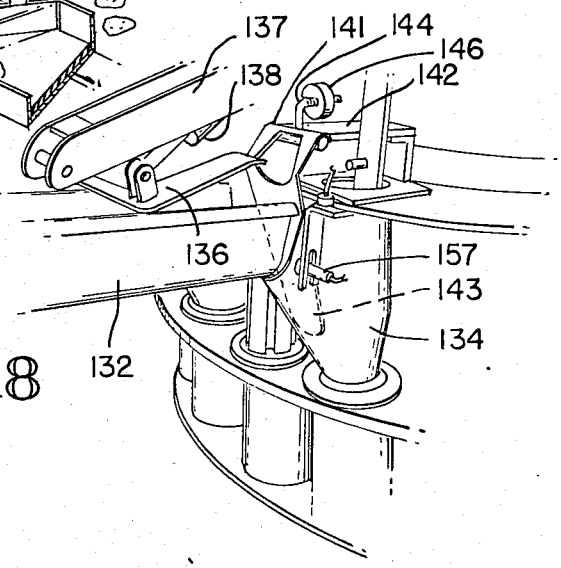
FIG. 18 is a perspective view of the indexing mechanism of the feed system with parts broken away.

As illustrated in FIGS. 17–23, the loading of potatoes into the feed cups 22 may be automated. Such automation is particularly important when a large number of closely spaced plunger units 42 and cutting units 56 are mounted about the machine. As shown in FIG. 18 these cutting units may be spaced with only a single feed cup 22 between them. The automatic feed mechanism of the present invention includes an annular conveyor 112 which is similar in construction to the conveyor 18 shown in FIG. 1. As shown in FIGS. 20–23, however, this conveyor 112 is mounted above the level of the feed cups 22 so that potatoes can be fed to the cups 22 along a downward path. A plurality of pneumatically operated diverter assemblies 113 are provided at positions spaced above the conveuyor 112 for diverting potatoes from the conveyor 112 into the hoppers 114 associated with the diverter assemblies 113. As shown in FIGS. 21 and 23, each hopper is associated with a pair of chutes 116 which feed the potatoes past an indexing system 116 which prevents more than one potato from entering a feed cup 22.

Referring next to FIGS. 17 and 20–23, the conveyor 112 is rotatably mounted to the frame 14 and driven in like manner to the conveyor 18 shown in FIG. 1. The inner and outer walls 117, 118 bounding the annular conveyor 112, however, are fixed and do not rotate with the conveyor 112.

Each pneumatic diverter assembly 113 is positioned adjacent a hopper and may be actuated to sweep potatoes off the conveyor 112 and into an associated hopper 114. The diverter assembly includes a diverter gate 119 which is pivotably mounted adjacent the wall 117 by means of a hinge 121. The diverter gate 119 is moved between a retracted position as illustrated in FIG. 21 and an advanced position as illustrated in FIG. 23 by means of a pneumatic actuator 122 and is formed so that, it conforms to the interior wall 117 which bounds the conveyor 112. As such, when the gate is in its retracted position, the conveyor can circulate potatoes past the retractor diverter gate 119. The pneumatic actuator 122, like the remaining pneumatic actuators of the present apparatus are controlled by servo values which operate in response to electrical signals from the control system.

Figure 19:
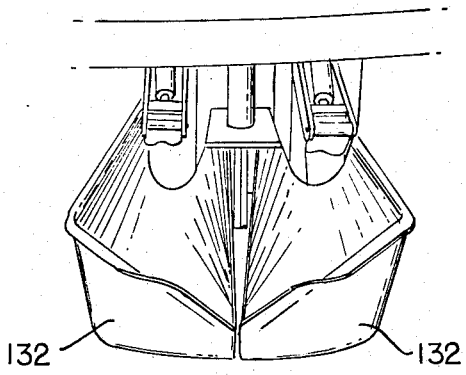
FIG. 19 is a perspective view of the feed chute and indexing assembly with parts broken away.

In order that potatoes may be swept off the conveyor 112 and into the hopper 114 by the diverter gate 119, an aperture is provided in the wall 118 opposite the diverter gate 119. A pair of doors 123, 124 are positioned to fill this aperture and are operated by a second pneumatic actuator 126. The first door 123 is pivotably mounted to the wall 118 by means of a vertically extending hinge 127, while the second door 124 is hinged along its top. A pin 129 extends upwardly from the first door and passes through an aperture in a block 131 which is mounted to the second door 124. Thus, movement of the second door 124 by the pneumatic actuator 126 also results in opening or closing of the door 123. The pneumatic actuator 122,126 and The hopper 114 is positioned to receive potatoes diverted into it by the diverter gate 119 and conducts the potatoes downward to a pair of chutes 132 each of which is vibrated along its longitudinal axis by a vibrator 133. As illustrated in FIGS. 19 and 21, each of these cutes is deeply troughed and becomes narrower with increasing distance from the hopper. The chute is inclined downwardly away from the hopper 114 to guide potatoes downward away from the hopper and towards the feed cups 22. Preferably, the chutes 132 are made of sheet metal which has been formed with an irregular, textured surface such as by embossing the sheet metal with a pattern of recesses and prominences. Such a textured surface aids both the movement of the potatoes along the chute 132 and the alignment of the longitudinal axis of the potato with the longitudinal axis of the chute 132.

The vibrating chute 132 terminates at the mouth of a descending, funnel shaped vertical chute 134 which ends just above the loading position of a feed cup. The chute 132 and the vertical chute 134 are not connected. A small gap is provided between the two chutes 132, 134 such that the vibrating chute 132 is free to vibrate while the funnel shaped chute remains stationary.

An indexing mechanism 116 is positioned near the end of each chute 132. As shown in FIG. 18, this indexing mechanism 116 includes a tongue 134 which is hinged at one end to a support arm 137. The tongue is moved between a retracted position as illustrated in FIG. 20 and an advanced position as illustrated in FIG. 22 by means of a double acting pneumatic cylinder 138 which is pivotably connected at one end to the tongue 136 and at the other to the support arm 137. The tongue is bent such that the free end thereof extends generally parallel to the bottom of the chute 132 when the pneumatic cylinder 138 moves it into its advanced position as illustrated in FIG. 22. The lower surface of this free end 139 is generally concave to conform to the upper surface of a potato.

A curved plate 141 is positioned to hang in the funnel shaped vertical chute 134. This plate is hinged to a support 142 so that its concave potato-engaging surface 143 may be pivoted away from the end of the vibrating chute 132. A counterbalance support arm 144 is connected to the top of the plate 141 and extends away from the end of the chute 132. A weight 146 is threaded onto the counterbalance arm 144 and can be positioned thereon to bias the concave surface 143 of the plate 142 toward the end of the chute 132.

Potatoes are loaded onto the annular conveyor 112 by means of a belt type loading conveyor 115. This conveyor is controlled to load potatoes onto the annular conveyor 112 as needed to maintain an adequate supply of potatoes.

The automatic loading mechanism is controlled in response to three sensors. As shown in FIGS. 17 and 20, a pair first sensors 147 is mounted above the annular conveyor 112 on a support 148. These sensor each comprises a light source 149 and a light detector 151. The light source 149 and a light detector 151. The light source 149 emits a beam of light downward onto the surface of the annular conveyor 112. The light detector 151 is mounted on the arm 148 in position to receive light reflected from the annular conveyor 112. When potatoes are not present on the conveyor, the beam emitted by the light source is reflected back to the light detector. When the conveyor is full of potatoes, however, the bean is scattered and the light senses the absence of the beam.

As shown in FIGS. 20–23, the second sensor 152 comprises a light source 153 and light detector 154 mounted on opposite sides of the two adjacent chutes 132. The light source 153 projects its beams through apertures 156 in the walls of the chutes 132 which beam is received by the light detector 154 unless blocked by potatoes in the chutes 132. The apertures 156 are of sufficient size that the oscillatory motion of the chutes 132 does not result in periodic interruption of the beam.

As shown in FIG. 18, the third sensor 157 is mounted at the end of the chute 132. The light source and detector 158, 159 that comprise this detector are mounted on opposite sides of the chute. The beam projected from the light source 158 to the detector 159 is positioned at an elevation above the bottom of the chute such that it will be blocked by a potato moving down the chute 132 into the funnel shaped vertical chute 134.

The feed system 115 comprises a conveyor 161 which extends generally tangentially to the annular conveyor 112. Potatoes are swept from the conveyor 161 out the annular conveyor 112 by means of a sweep plate which is operated by a two stage pneumatic cylinder 163 such that it can be moved between a retracted, closed position, a position in which it extends completely across the conveyor 161 at an angle, and a position in which it extends only partially across the conveyor 161.

In operation, potatoes are circulated past the several diverter assemblies 113 by the annular conveyor 112. During this circulation, the first sensor 147 monitors the supply of potatoes on the annular conveyor 112. When no potatoes are detected by either of the sensors 147 the cylinder 163 is energized to fully open the sweep gate 162 to load potatoes onto the conveyor 112. If potatoes are not present under only one of the sensors 147, the pneumatic cylinder 163 is energized only to open the sweep gate only part way. Since the feed system 115 is positioned downstream from the sensors 147, potatoes are added to the conveyor 112 at approximately the location where the deficiency was detected. Potatoes are loaded onto the conveyor 112 until the sensors 147 detects that an adequate supply of potatoes is present, after which the gate is closed. Preferably, the feed system 115 is energized to supply potatoes only when approximately six inches or more of conveyor 112 has passed beneath the sensors 147 without detection of a potato.

The several pneumatic diverter assemblies likewise operate only as needed to replenish the supply of potatoes in the hoppers 114. The diverter assembly 113 operates in response to the second sensor pair 152. So long as the light beam between the light source 153 and light detector 154 of this sensor 152 remain blocked by the presence of potatoes in the chutes 132, the diverter gate 119 remains in its retracted position against the inner wall 117. When the light beam between the source 153 and detector 154 is unblocked, indicating an absence of potatoes in the hopper 114 and the chutes 132, the pneumatic cylinder 121 is energized to advance the diverter gate 119 to the position illustrated in FIGS. 22 and 23. Simultaneously, the pneumatic actuator 126 is energized to open the doors 123, 124 and admit potatoes into the hopper 114. As soon as the sensor 152 detects the presence of potatoes in the chutes 132, the doors are closed and the diverter gate 119 and doors 123, 124 are retracted to the positions shown in FIGS. 20 and 21.

As explained above, the chutes 132 are downwardly inclined and are reciprocated at a high rate by the vibrator 133. The potatoes thus move downward and inward toward the end of the chute. As illustrated in FIGS. 18–23, the chutes 132 narrow toward their end and the adjacent, interior walls of each pair of chutes 132 gradually becomes higher. As a result of this chute 132 configuration and of the vibration imparted by the vibrator 133, the longitudinal axis of the potatoes becomes aligned with the longitudinal axis of the chutes as the potatoes move toward the indexing system 116.

The indexing system 113 is controlled in response to the third sensor 157. The function of the index system is to ensure that only a single potato is deposited in each feed cup 22 and that potatoes are not permitted to enter the funnel shaped vertical chute 134 when the feed cups 22 are being moved into position above one of the cutting heads 56 as described above.

Figure 9:
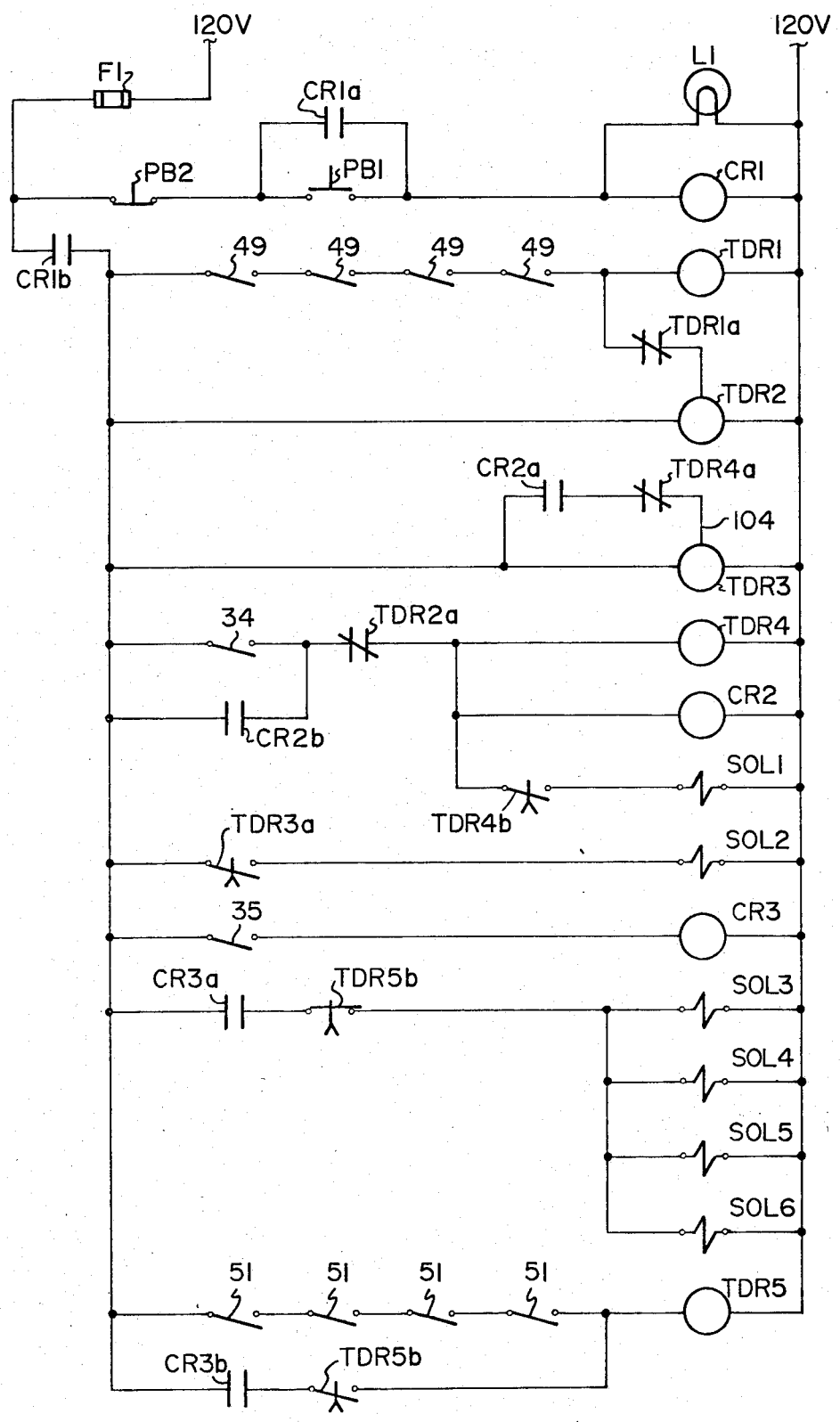
FIG. 9 is an electrical schematic of the automatic sensing and control mechanism.

In operation, potatoes are transported to the annular conveyor 18 by a vibrating conveyor 19. Workers are positioned about the periphery of the machine to take potatoes from the conveyor 18 and insert them into the cups 22 mounted on the feed table 19. As illustrated in FIG. 9, when the power is turned on power flows to the control circuit through the fuse F1. The machine remains inactive until energized by the pressing of the start switch PB1. When this switch is pressed, power flows through the normally closed switch PB2 to the coil of the first relay CR1 causing the contacts CR1*a* to close and bypass the start switch PB2. The contacts CRSb also close, providing power to the rest of the circuit. When power is applied, the pneumatic cylinders 43 are in their retracted position and the upper limit switches 49 are therefore closed. Consequently, the delay-on-operate time delay relay TDR1 is energized. In addition the ratched drive cylinder 29 is retracted and the limit switch 34 is closed. The contact of this relay is normally closed and thus the energizing of this relay supplies power to the energizing line 103 of the delay-on-release time delay relay TDR2. Voltage is thus applied to the delay-on-operate relay TDR4 and the bypass relay CR2. When TDR2 energizes, the contacts TDR2*a* open, releasing the delay-on-operate relay TDR4, the relay CR2 and the ratchet solenoid valve releases, retracting the cylinder and closing the limit switch 34. The time delay relay TDR2 then de-energizes, closing the contacts TDR2*a*. On closure of the limit switch 34, the delay-on-operate relay TDR4 is energized and the relay CR2 closes. The energizing of this relay CR2 bypasses the limit switch 34 maintaining current through the closed contacts TDR2*a*. The contacts TDR2*b* also close, energizing the delay-on-release time delay relay TDR3. This results in the closure of the contacts TDR3*a*, actuating the solenoid valve SOL2 which supplies air to the lock cylinder 31. This cylinder then retracts the latch 38 to free the feed table 19 to rotate.

The time delay relay TDR4 then de-energizes opening the contacts TDR4*a* and TDR4*b*. This supplies current to the energized line 104 of the delay-on-release time delay relay TDR3. As a result, the contacts TDR3*a* close causing the solenoid valve controlling the ratchet drive cylinder is energized causing the cylinder to extend. This results in rotation of the ratchet wheel 36 and feed table 19. As the drive cylinder extends, the time delay on TDR3 runs out and the contacts TDR3*a* open the solenoid valve SOL2 which controls the lock cylinder 31. The latch 38 then moves into contact with the edge of the feed table 19. The stroke of the ratchet cylinder 29 continues until it is fully extended at which time the limit switch 35 closes. This signals that the feed table 19 has been rotated to bring one of the teeth 39 into contact with the latch 38 and that cups 22 are in position above the cutting units 56. Accordingly, when the limit switch 35 closes, the relay CR3 is energized. The contacts CR3*a* then close, energizing the plunger cylinder solenoid valves SOL3-6 which supply compressed air to extend the plunger cylinders 43. The cylinders 43 then begin to extend, opening the limit switches 49 and extending the plunger head 47 to each push a potato from the cups 22 into the holder 57. The fingers 63 in the holder 57 are pushed outward as the potatoes enter the tubular bodies 62 and grip the potatoes by their sides, aligning them vertically and holding them against rotation as shown in FIGS. 10 and 11.

Figure 16:
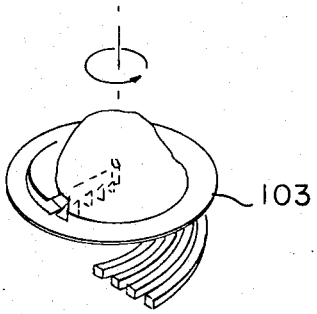
FIG. 16 is a schematic representation of a potato being cut by the cutting blade assembly of FIG. 15.

The downward stroke of the cylinders 43 forces the potatoes into contact with the rotating cutter assemblies 58. The slitting knives 78 first cut a plurality of concentric grooves in the potatoes and the potato is then helically sliced by the transverse blade 77 as shown in FIGS. 12 and 13. The cutting continues until the cylinder reaches full extension at which time the plunger head 47 has moved down to the level of the transverse blade 77. The slitting knives 78, which extend upward past the level of the transverse blade 77 are received in the concentric grooves 54 in the lower end of the plunger. As the plunger head moves downward through the holder, the vertical grooves 53 in the plunger head 47 receive the fingers. These grooves 53 are of sufficient depth to avoid interference with the fingers, which must continue to hold the potato against rotation throughout the entire downward stroke of the cylinder 43. If the blade assembly of FIG. 15 is used, of course, a cylindrical core is also cut from the potato as shown in FIG. 16.

Full extension of all of the cylinders 43 also results in the closing of the lower limit switches 51 and the energization of the delay-on-operate time delay relay TDR5. Since the circuit is not complete until all of the cylinders 43 are fully extended, potatoes of different size requiring different cutting times may be simultaneously cut by the apparatus. After a brief delay to allow for completion of the cutting process, the contacts TDR5*a* open to de-energize the solenoid valves SOL3-6, resulting in retraction of the plunger head 47. When all of the cylinders 43 have retracted, closing the upper limit switches 49, the cycle commences again with actuation of the ratchet mechanism 13.

The operation of the device may also be advantageously monitored and controlled by a conventional programmable controller. One such programmable controller which may be used is the Texas Instrument 530 programmable controller which is provided by the industrial systems division of Texas Instruments, Inc. of Johnson City, Tenn. This programmable controller may be interfaced in a known manner to the various switches, sensors and servo valves of the apparatus to control its function.

The Texas Instruments, Inc., model 530 programmable controller is designed to control machines by stepping through its program and performing specific functions in response to various internal pulses which may have a duration, for example, of one complete program cycle. As such, the computer may repeatedly bypass an instruction to energize the servo valve which controls a cylinder until conditions are satisfied in a preceding instruction and a pulse is sent on an internal control line to indicate establishment of the desired condition precedent to operation of the cylinder. As such, the processor in the programmable controller may examine each instruction and the conditions precedent for its execution many times per second. This ensures that all machine functions are carried out on a timely basis and that it is not necessary, for example, to wait for the index table to complete its movement before the next function can be carried out. Setting up a machine control program to operate in this manner is well known in the art. For sake of clarity in explaining the program, the various functions and the conditions for their execution have been grouped and described in conventional flow chart form.

Figure 24:
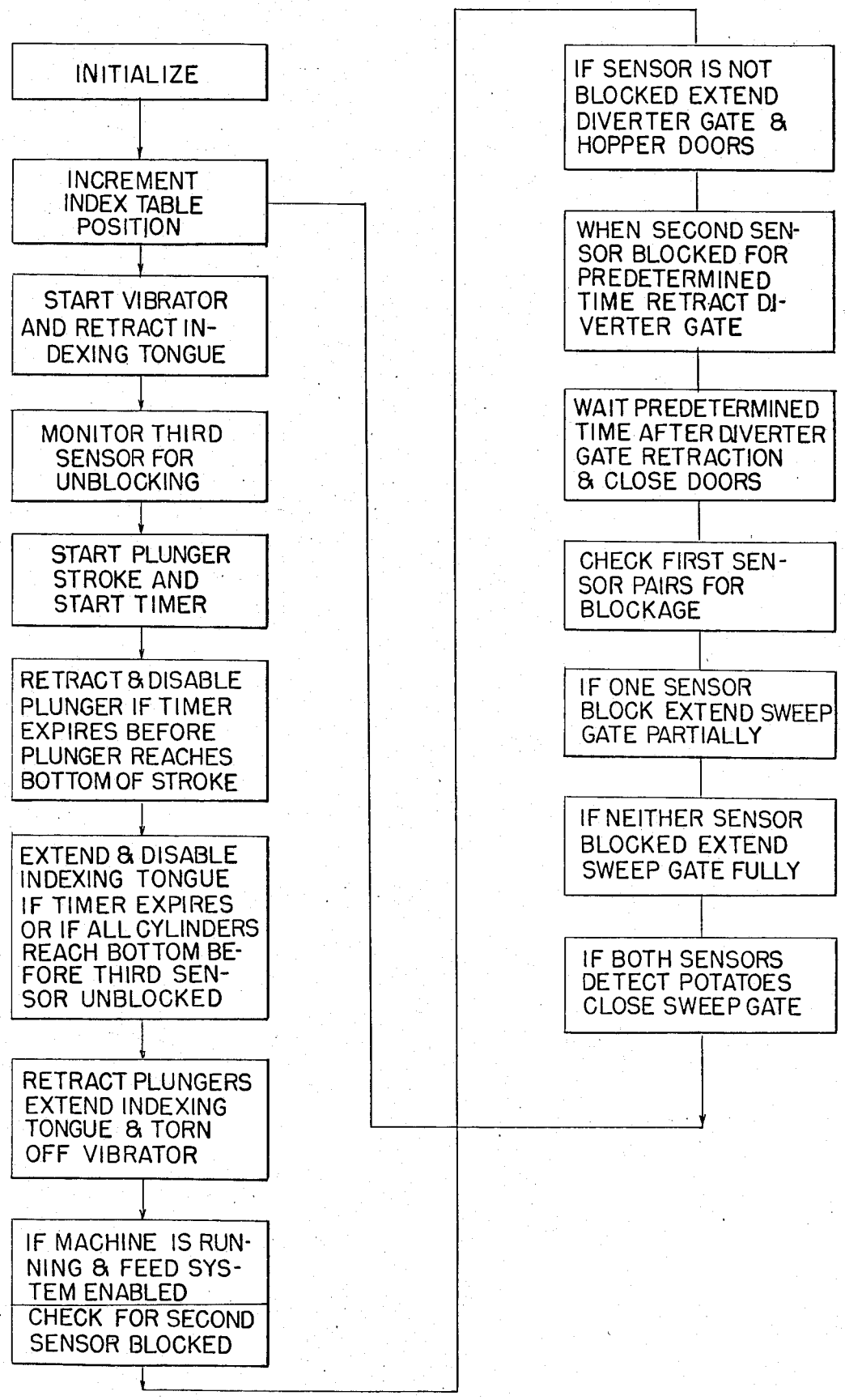
FIG. 24 is a flowchart of a programmable controller used to control the sequence of operation of the present apparatus.

As illustrated in FIG. 24, the first step 164 is the initialization of the machine including the setting of timers for later use. Rotation of the index table is next initiated. In subsequent sweeps through the program, the programmable controller will turn off the drive to the index table 19 when it has completed its indexing as indicated by cam actuated limit switches (not shower). Once movement of the table is complete, the vibrator 133 is then turned on and the tonque 136 is retracted to allow the feeding of a potato to the feed cup 22. The programmable controller next executes a step 166 to determine whether the third sensor positioned at the end of the chute 132 has been unblocked. In repeated passes through the program, the programmable controller monitors the state of this third sensor 157 to determine when the light beam between the source and detector pair 158, 159 has been blocked and then unblocked indicating the passage of a potato through the sensor 157. Also after the motion of the index table has stopped, the cylinders 43 which operate the plunger 47 are energized to move downward. At this point 167, a timer is also started in order to set a maximum transit time for the stroke of the cylinder 43. If the timer expires before one or more of the plungers reach the bottom of their stroke, as indicated by closure of the lower limit switches 51, such plungers are retracted and diabled. In addition, if any of the third sensors have not been blocked and unblocked either before this timer expires or before all cylinders 43 reach the bottom of their stroke, the tongue 153 associated with such sensors is extended and disabled. If both indexing systems 112 which are supplied by the same hopper 114 are disabled, the diverter assembly 113 serving that hopper 114 is also disabled.

In the next step, all plungers which have not been retracted and disabled are retracted. Likewise, with respect to all indexing systems which have not been disabled, the tongues 136 are extended and the vibrators 133 are turned off.

In the next step, 169, if the machine is still operating and the feed system has not been disabled, the programmable controller checks for blockage of each of the second sensors 153.

If any one of the second sensors is not blocked, the supply of potatoes in the associated hopper has been depleted. In order to replenish the supply, the diverter gate 119 is extended and the doors 123, 124 opened to admit potatoes into the hopper 114. After the sensor 152 has been blocked for a predetermined period of time, the diverter gate is retracted and a short time later the doors 123, 124 are closed.

During each cycle, the programmable controller also checks the pair of first sensors for blockage by potatoes. In a subsequent step 171, if only one of the sensors is blocked, the sweep gate 162 is opened part way. If neither sensor is blocked by potatoes, however, the sweep gate will be fully opened. After the gate 162 has been opened, the programmable controller monitors the sensors and closes the sweep gate when an adequate supply of potatoes is detected by blockage of both sensors. The programmable controller then returns to continue execution of the program.

Although the present invention may be adapted to the cutting of other vegetables, it is described herein with particular reference to potatoes for illustrative purposes and is not limited solely to the helical cutting of potatoes.

We claim:

1. Apparatus for cutting articles into helical strips comprising;

at least one holder having a longitudinal passage therein, and a plurality of inwardly biased members extendable in said passage to align and hold an article therein against rotation while the article is being cut into helical strips and pivotally connected to said holder and extended through slots in said holder into said holder passage;

a rotary cutter mounted adjacent each said holder, including a blade assembly oriented to cut an article into a plurality of helical strips as the held article is pushed through said passage;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly.

2. The apparatus of claim 1 wherein said rotary cutter blade assembly includes a plurality of slitting knives oriented to cut concentric circles in the end of an article held within said passage and a traverse blade oriented to sever the concentrically-cut end of an article into a plurality of helical strips as the held article is pushed through said passage.

3. The apparatus of claim 2 wherein said plunger includes an article-contacting face provided with recesses therein adapted to receive said slitting knives to enable said plunger to push an article completely into said blade assembly unimpeded by said blade assembly.

4. Apparatus for cutting articles into helical strips comprising;

at least one holder having a longitudinal passage therein, and a plurality of inwardly biased members extendable in said passage to align and hold an article therein against rotation while the article is being cut into helical strips;

a rotary cutter mounted adjacent each said holder, including a blade assembly oriented to cut an article into a plurality of helical strips as the held article is pushed through said passage, and comprising a plurality of slitting knives oriented to cut concentric circles in the end of an article held within said passage and a traverse blade oriented to sever the concentrically-cut end of an article into a plurality of helical strips as the held article is pushed through said passage, and a cylindrical cutting tube positioned at the axis of rotation of, and extended beyond, said slitting knives to first engage the end of an article and cut a cylindrical core from the article as the article is pushed into said blade assembly;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly.

5. The apparatus of claim 4 wherein said plunger includes an article-contacting face provided with recesses therein adapted to receive said slitting knives and said cutting tube to enable said plunger to push an article completely into said blade assembly unimpeded by said blade assembly.

6. Apparatus for cutting articles into helical strips comprising;

at least one holder having a longitudinal passage therein, and a plurality of inwardly biased members extendable in said passage to align and hold an article therein against rotation while the article is being cut into helical strips;

A rotary cutter mounted adjacent each said holder, including a blade assembly oriented to cut an article into a plurality of helical strips as the held article is pushed through said passage;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly, and including a receiver for accumulating a plurality of articles:

and a distributor for transferring articles seriatim to said holder including at least one tubular member having an article distribution passage therein, a moveable control member positioned between said holder and said tubular member to control transfer of articles therebetween, said plunger being mounted for axial movement through said article distribution passage into said holder passage to transfer an article from said feeder to said holder for cutting into helical strips.

7. The apparatus of claim 6 wherein said article feeder includes a controller having sensors to determine the relative positions of said article feeder tubular member, said control member and said holder; and includes an actuator responsive to said sensors to axially move said plunger through said distribution passage into said holder passage when predetermined relative positions are attained among said article feeder tubular member, said control member and said holder.

8. Apparatus for cutting articles into helical strips comprising;

at least one holder having a longitudinal passage therein, a plurality of inwardly biased members extendable in said passage to align and hold an article therein against rotation while the article is being cut into helical strips;

said holder including a spring support and a plurality of springs acting between said spring support and the article aligning and holding members to inwardly bias said members into engagement with an article in said holder passage, a base support mounting said holder and said spring support, and a plurality of links extending through apertures in said spring support and each pivotally connected to an inwardly biased member and enclosed by one of said springs:

a rotary cutter mounted adjacent each said holder, including a blade assembly oriented to cut an article into a plurality of helical strips as the held article is pushed through said passage;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly.

9. Apparatus for cutting articles into helical strips comprising;

at least one holder having a longitudinal passage therein, and a plurality of inwardly biased members extendable in said passage to align and hold an article therein against rotation while the article is being cut into helical strips;

a rotary cutter mounted adjacent each said holder, including a blade assembly oriented to cut an article into a plurality of helical strips as the held article is pushed through said passage;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly, and a receiver for accumulating a plurality of articles; and a distributor for transferring articles seriatim to said holder, including a downwardly sloping vibratory chute having a first end for accepting articles from said receiver, a lower second end and a narrowing midportion arranged to orient articles serially and longitudinally as said vibrator chute transports articles from said first end to said second end, and at least one tubular member having an article distribution passage therein arranged to accept articles from said chute.

10. The apparatus of claim 9 wherein said distributor includes a moveable control member positioned between said holder and said tubular member to control transfer of articles therebetween; and wherein said plunger is mounted for axial movement through said article distribution passage into said holder passage to transfer an article from said feeder to said holder for cutting into helical strips.

11. Apparatus for cutting articles into helical strips comprising;

at least one holder having a longitudinal passage therein, and a plurality of inwardly biased members extendable in said passage to align and hold an article therein against rotation while the article is being cut into helical strips;

a rotary cutter mounted adjacent each said holder, including a blade assembly oriented to cut an article into a plurality of helical strips as the held article is pushed through said passage, a rotatable drive tube detachably mounting said blade assembly at one end, a stationary tubular discharge chute extended through the other end of said drive tube into adjacency with said blade assembly for receiving said discharging helically-cut strips, and drive means connected to said drive tube to rotate said drive tube and said blade assembly about the longitudinal axis of said drive tube;

and an article feeder including a plunger associated with each said holder and axially moveable in said passage for pushing an article through said passage into said blade assembly, said plunger having a periphery configured to cooperate with the article aligning and holding members to enable said members to maintain positional control over an article during movement into said blade assembly.

12. The apparatus of claim 11 wherein said rotary cutter includes a cutter support housing rotatably mounted said drive tube and having water flushing passages therein opening to flush said blade assembly during cutting; and includes a spray shield mounting said discharge chute to contain water running out of said drive tube.

13. Apparatus for cutting articles into helical strips comprising;

at least one holder having a longitudinal passage a rotary cutter mounted adjacent each said holder, including a blade assembly oriented to cut an article into a plurality of helical strips as the held article is pushed through said passage;

an article feeder including a plunger associated with each said holder and axially moveable in said passage for pushing an article through said passage into said blade assembly;

a receiver for accumulating a plurality of articles: and a distributor for transferring articles seriatim to said holder including at least one tubular member having an article distribution passage therein, a moveable control member positioned between said holder and said tubular member to control transfer of articles therebetween; and wherein said plunger is mounted for said holder passage to transfer an article from said feeder to said holder for cutting into helical strips.

14. The apparatus of claim 13 wherein said article feeder includes a controller having sensors to determine the relative positions of said article feeder tubular member, said control member and said holder; and includes an actuator responsive to said sensors to axially move said plunger through said distribution passage into said holder passage when predetermined relative positions are attained among said article feeder tubular member, said control member and said holder.

15. Apparatus for cutting articles into helical strips comprising;

at least one holder having a longitudinal passage a rotary cutter mounted adjacent each said holder, including a blade assembly oriented to cut an article into a plurality of helical strips as the held article is pushed through said passage;

an article feeder including a plunger associated with each said holder and axially moveable in said passage for pushing an article through said passage into said blade assembly;

a receiver for accumulating a plurality of articles:

a distributor for transferring articles seriatim to said holder including a downwardly sloping vibratory chute having a first end for accepting articles from said receiver, a lower second end and a narrowing midportion arranged to orient articles serially and longitudinally as said vibrator chute transports articles from said first end to said second end; and includes at least one tubular member having an article distribution passage therein arranged to accept articles form said chute.

16. The apparatus of claim 15 wherein said distributor includes a moveable control member positioned between said holder and said tubular member to control transfer of articles therebetween; and wherein said plunger is mounted for axial movement through said article distribution passage into said holder passage to transfer an article from said feeder to said holder for cutting into helical strips.

17. Apparatus for cutting articles into helical strips comprising;

at least one holder having a longitudinal passage a rotary cutter mounted adjacent each said holder, including a blade assembly oriented to cut an article into a plurality of helical strips as the held article is pushed through said passage, a rotatable drive tube detachably mounting said blade assembly at one end, a stationary tubular discharge chute extended through the other end of said drive tube into adjacency with said blade assmbly for receiving and discharging helically-cut strips, and drive means connected to said drive tube to rotate said drive tube and said blade assembly about the longitudinal axis of said drive tube an article feeder including a plunger associated with each said holder and axially moveable in said passage for pushing an article through said passage into said blade assembly;

a receiver for accumulating a plurality of articles: and a distributor for transferring articles seriatim to said holder.

18. The apparatus of claim 17 wherein said rotary cutter includes a cutter support housing rotatably mounting said drive tube and having water flushing passages therein opening to flush said blade assembly during cutting; and includes a spray shield mounting said discharge chute to contain water running out of said drive tube.

* * * * *